US006527058B1

(12) United States Patent
Nerat

(10) Patent No.: US 6,527,058 B1
(45) Date of Patent: Mar. 4, 2003

(54) PORTABLE WET CHEMICAL FIRE EXTINGUISHER

(75) Inventor: John Richard Nerat, Wallace, MI (US)

(73) Assignee: Walter Kidde Portable Equipment, Inc., Charlottesville, VA (US)

( * ) Notice: Subject to any disclaimer, the term of this patent is extended or adjusted under 35 U.S.C. 154(b) by 0 days.

(21) Appl. No.: 09/371,254

(22) Filed: Aug. 10, 1999

(51) Int. Cl.[7] ..... A62C 11/00
(52) U.S. Cl. ..... 169/30; 169/74; 239/288.3
(58) Field of Search ..... 169/30, 71, 74, 169/75–89; 239/288–288.5

(56) References Cited

U.S. PATENT DOCUMENTS

| | | | | | |
|---|---|---|---|---|---|
| 1,967,894 | A | * | 7/1934 | Mapes | 169/30 |
| 2,050,032 | A | * | 8/1936 | Allen et al. | 169/74 |
| 2,062,713 | A | * | 12/1936 | Hill, Jr. | 169/74 |
| 2,117,684 | A | * | 5/1938 | Schaaf | 169/30 |
| 2,151,076 | A | * | 3/1939 | Betzler | 169/30 |
| 2,218,189 | A | * | 10/1940 | Allen | 169/30 |
| 2,371,959 | A | * | 3/1945 | Duffield et al. | 169/30 |
| 2,489,339 | A | * | 11/1949 | Stroop | 169/74 |
| 2,541,554 | A | * | 2/1951 | Smith | 169/71 |
| 2,545,951 | A | * | 3/1951 | Frese et al. | |
| 2,547,018 | A | * | 4/1951 | Kucher | |
| 2,566,324 | A | * | 9/1951 | Frese | |
| 2,985,383 | A | * | 5/1961 | Rasmusson | 169/74 |
| 3,172,607 | A | * | 3/1965 | Riuli et al. | |
| 3,313,353 | A | * | 4/1967 | Williamson et al. | |
| 3,702,637 | A | * | 11/1972 | Bower | 169/30 |
| 4,886,122 | A | * | 12/1989 | Goodnight | 169/74 |
| 6,113,004 | A | * | 9/2000 | Steingass et al. | 169/30 |

* cited by examiner

*Primary Examiner*—Michael Mar
*Assistant Examiner*—Dinh Q. Nguyen
(74) *Attorney, Agent, or Firm*—Moore & Van Allen PLLC; Michael G. Johnston

(57) ABSTRACT

A portable, wet chemical fire extinguisher for kitchen applications comprising a pressurized cylinder containing a fire suppressing wet chemical, a discharge assembly including an outlet in fluid communication with the cylinder, and a grip element mounted on the discharge assembly for requiring a user's hand position adjacent the outlet for delivery of the fire suppressing agent. The grip element necessitating the appropriate hand positioning may comprise a guard surrounding the outlet for protecting the outlet as well as the user's fingers. The guard can be cup-shaped, but may assume any configuration requiring natural hand placement adjacent the outlet. The user of the fire extinguisher of the present invention is thereby prevented from moving closer than a safe distance from the fire and from the placing the outlet in or adjacent to the fire area even when the fire is out.

18 Claims, 3 Drawing Sheets

PORTABLE WET CHEMICAL FIRE EXTINGUISHER

BACKGROUND

This invention relates generally to fire extinguishers, and more particularly to a portable wet chemical fire extinguisher for kitchen applications.

Kitchen cooking fires represent the single most common reason restaurants are damaged by fire. The origin of these fires is typically associated with commercial cooking appliances, such as deep fat flyers. The potential for severe restaurant fires continues to grow as the restaurant industry moves toward larger, more efficient cooking appliances which utilize higher heating rates and more unsaturated fats. Moreover, some combustible cooking materials, such as animal and vegetable fats and oils, can retain their auto re-ignition temperature for an extended period of time, up to twenty minutes. Thus, kitchen cooking fires represent a unique fire protection hazard that requires special fire suppression agents and equipment.

The National Fire Protection Association recently designated a new Class "K" portable wet chemical fire extinguisher for use in commercial kitchen areas, and particularly for commercial "combustible cooking media" fire hazards (NFPA-10 Standard For Portable Fire Extinguishers 1998 Edition).

The conventional K class fire extinguisher comprises a pressurized cylinder containing a fire suppressing agent and an outlet hose having an 18 to 20 inch long metal discharge wand. At the end of the wand is a nozzle for delivering the agent in a fine mist so as not to splash the liquid cooking media. The fire suppressing agent is a low pH, potassium acetate solution which does not react with the liquid cooking media during application. The agent saponifies on the liquid surface creating a thick, heavy foam blanket to seal out oxygen for extended periods of time until the liquid cooking media cools below its auto re-ignition temperature. The agent also helps cool appliance surfaces.

The problem with the conventional K class fire extinguisher is the discharge wand presents potential misuse and safety concerns. The wand is designed to give the user an extended reach and a longer agent discharge range, which is initially limited due to delivery of the agent as a mist. However, the wand allows the user to get too close to the fire. If the user places the end of the wand through the flames into the cooking media and discharges the agent, the initial discharge of the pressurized, cool agent could produce a burst of burning, hot grease which blows up and out of the fryer. Even after the fire is out, if the wand tip is brought into contact with the grease the discharge will blow the foam blanket off the liquid surface thereby minimizing the effectiveness of the suppressing agent and possibly burning the user. In addition, utilizing the metal discharge wand near energized electrical equipment raises electrical shock concerns. K class fire extinguishers are typically used by kitchen personnel with little or no fire extinguishment training.

For the foregoing reasons, there is a need for a new portable wet chemical fire extinguisher for kitchen applications which eliminates the possibility of contacting the agent discharge outlet of the fire extinguisher with burning or hot cooking media. The new fire extinguisher should also minimize or eliminate the possibility of electrical shock when used around cooking appliances. Preferably, the new device should be simple enough to use so that the above goals are met even with novice users

SUMMARY

An object of the present invention is to provide a new fire extinguisher for kitchen applications that satisfies these needs and having one or more of the novel features of this invention as hereinafter shown or described.

Another object of the present invention is to minimize the safety risks to the user in extinguishing kitchen cooking fires, including preventing the possibility of fire blow ups or splashing hot cooking media.

Still another object of the present invention is to minimize the possibility of electrical shock when extinguishing fires around energized electrical appliances.

A further object of the present invention is providing the user, whether novice or experienced, with exceptional fire fighting safety and comfort.

A portable, wet chemical fire extinguisher for kitchen applications having features of the present invention comprises a pressurized container for housing the fire suppressing wet chemical, a discharge assembly having an outlet in fluid communication with the container, and means mounted on the discharge assembly for requiring a hand position adjacent the outlet for delivery of fire suppressing agent. The required hand position thereby prevents the user from moving closer than a safe distance from the fire and from the placing the outlet in, or adjacent to, the fire area even when the fire is out.

The hand positioning means may comprise a guard surrounding the agent delivery outlet. The guard can be cup-shaped, but may be any configuration which promotes natural hand placement adjacent the outlet. Preferably, the guard is made of a non-conductive, heat-resistant material such as plastic.

The present invention overcomes the drawbacks of present K class fire extinguishers through the provision of the hand positioning means such as the nozzle guard. With the user's hand adjacent the nozzle, the user cannot safely get too close to a cooking media fire, much less place the hose outlet in or near the cooking media. Moreover, by making the guard out of non-conductive material and large enough so that the guard does not fit into small places, the danger of electrical shock is significantly minimized. It has been found that these results can be achieved with the fire extinguisher of the present invention even though the user is a novice.

BRIEF DESCRIPTION OF THE DRAWINGS

For a more complete understanding of this invention, reference should now be had to the embodiment illustrated in greater detail in the accompanying drawings and described below.

In the drawings, wherein like reference numerals indicate like parts.

DESCRIPTION

Figure 1:
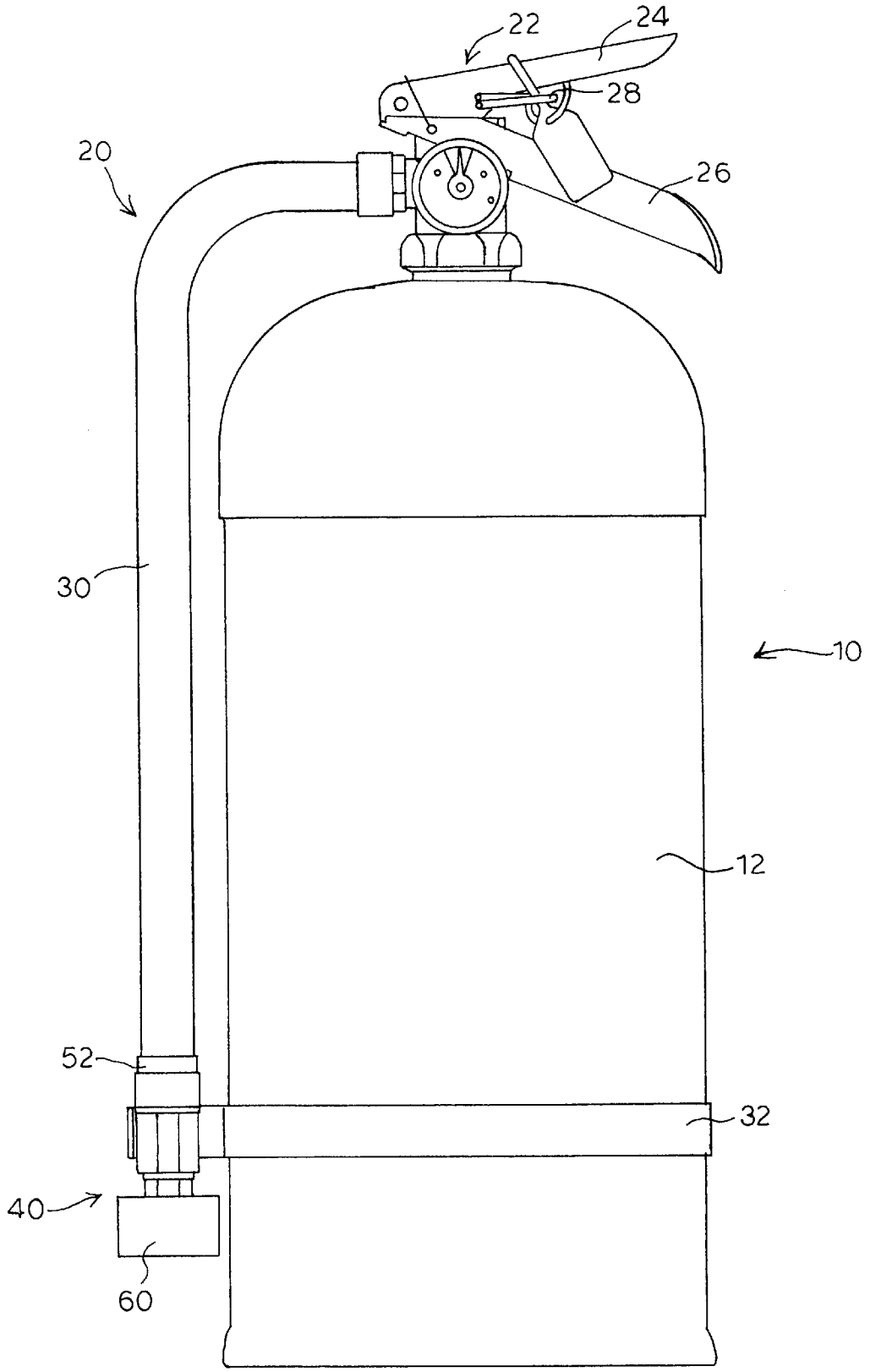
FIG. 1 is a elevation side view of a portable wet chemical fire extinguisher embodying features of the present invention.

Turning first to FIG. 1, there is shown a portable wet chemical fire extinguisher according to the present invention, generally designated at 10. The fire extinguisher 10 comprises a pressurized stainless steel cylindrical shell 12, containing a fire suppressing agent, and a discharge assembly 20. The size of the shell 12 depends on the predetermined volume of agent contained within the shell, which generally ranges from about 1.5 gallons to about 2.5 gallons. The pressure within the shell 12 is usually about 100 psi which provides an agent discharge range, as a mist, of about 8 to 12 feet.

The discharge assembly 20 comprises a valve assembly 22, a hose 30 and a nozzle assembly 40. The valve assembly 22 is conventional, including a handle 24, an actuating lever 26 pivotally attached to the handle 24 and a ring pin 28 for preventing accidental discharge. The valve assembly 22 is mounted on the surface of the shell 12, and is in fluid communication with the fire suppressing agent.

Figure 2:
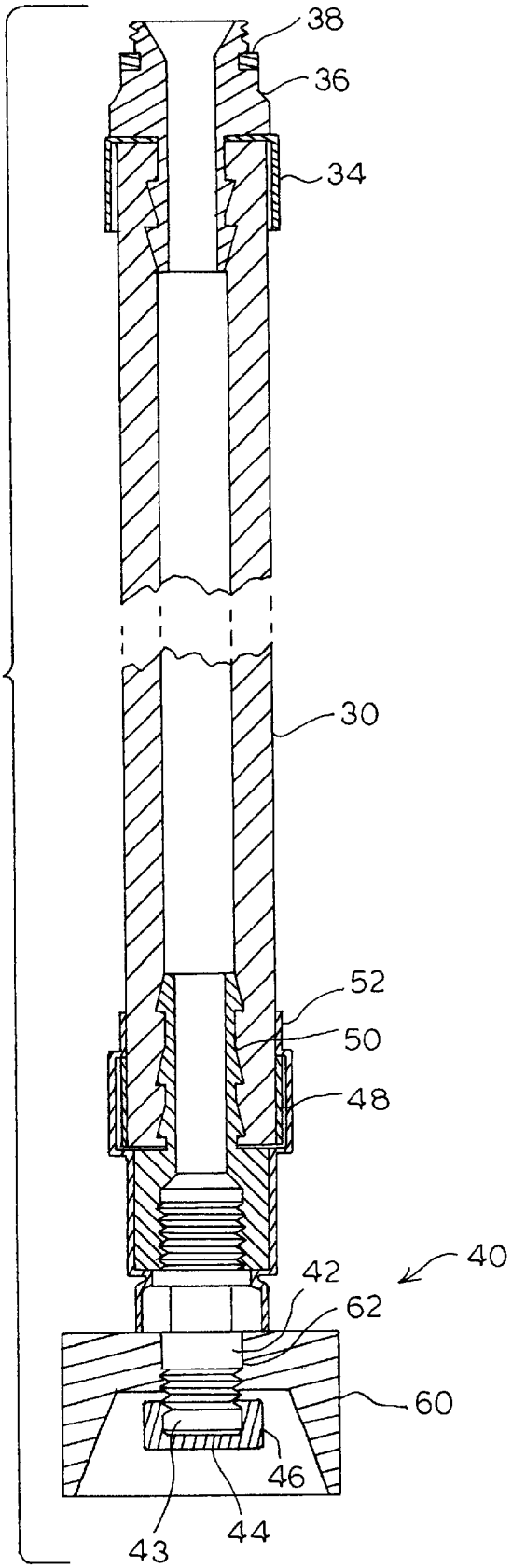
FIG. 2 is a longitudinal cross section view of the discharge assembly of the fire extinguisher shown in FIG. 1.

The hose 30 extends from the valve assembly 22 and carries discharged agent from the valve assembly to the nozzle assembly 40. The hose 30 is typically 18 inches long and made of a flexible material, such as rubber, so that the hose 30 hangs loosely from the valve assembly 22. A hose strap 32 is provided around the extinguisher bottom for holding the free end of the hose 30 against the shell 12 when not in use. As seen in FIG. 2, a ferrule 34 surrounds the upper end of the hose 30 to strengthen and protect the hose end. A threaded male adapter 36 is inserted in the hose end for securing the hose 30 to the valve assembly 22. A gasket 38 is provided to prevent leakage.

The nozzle assembly 40 includes a mist-generating nozzle tip 42, a protective dust cap 44 and an end nut 46. A ferrule 48 and a threaded female adapter 50 are inserted in the hose end for threadably receiving the nozzle tip 42. The dust cap 44 is an aluminum foil disc which fits over and seals the nozzle discharge orifice 43. The dust cap 44 is held in place with the brass end nut 46. The dust cap 44 prevents accumulation of grease or contaminants commonly associated with kitchen cooking areas from entering the orifice 43 where they could potentially restrict or prohibit the proper flow of agent. The dust cap 44 also serves as a visual inspection aid. The end nut 46 provides additional impact damage protection for the nozzle tip orifice 43. Shrink tubing 52 surrounds the whole arrangement, covering the metallic parts on the nozzle assembly 40 and minimizing the risk of electrical shock.

According to the present invention, FIG. 2 also shows a finger guard 60 at the free end of the hose 30. The finger guard 60 is cup-shaped, about 1 and ½ inches in diameter and ¾ inches deep. An axial opening 62 is provided in the base of the finger guard 60 which is large enough to allow the finger guard to slip over nozzle tip 42. The finger guard 60 is held in place by the end nut 46. The finger guard 60 provides a position on the hose 30 for the user to hold the hose during discharge, while at the same time protecting the fingers and hand of the user.

The finger guard also prevents the user from placing a finger over the discharge orifice tip where the finger could disturb the agent discharge stream pattern. The finger guard 60 is large enough that the user is prevented from inserting the nozzle assembly 40 into small areas, for example around cooking appliances, where the nozzle might come into direct contact with electrically-energized surfaces. Preferably, the finger guard 60 is plastic to further minimize the possibility of electric shock, but any non-conductive material is acceptable.

Figure 3:
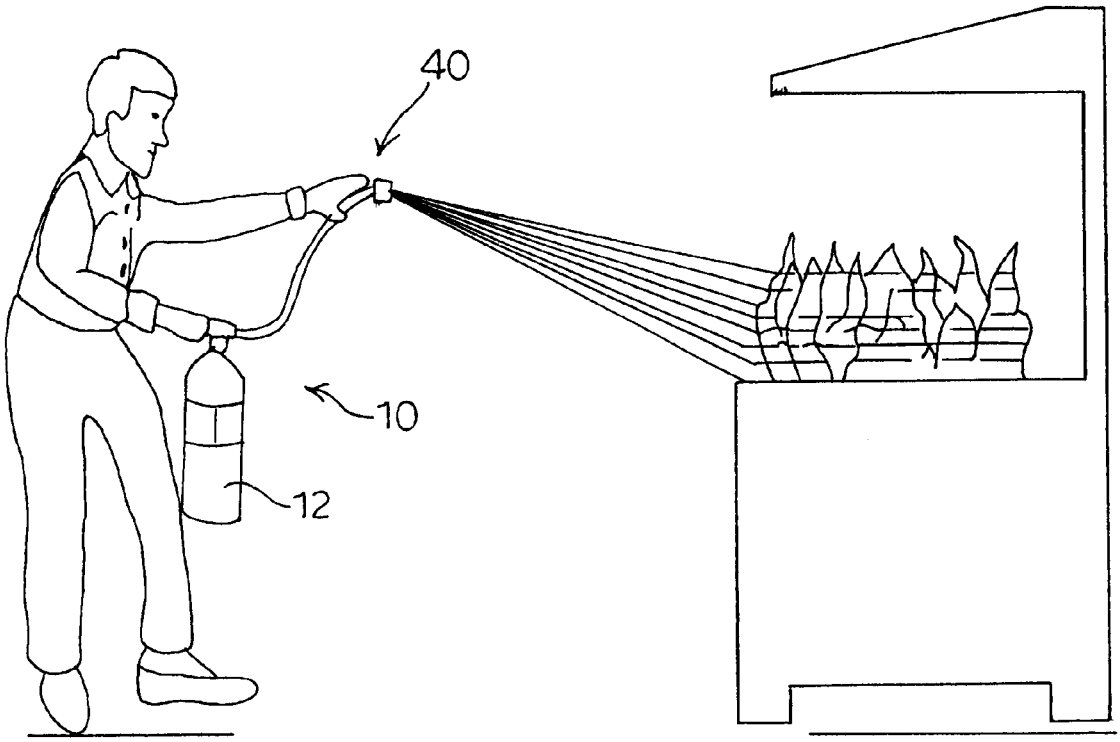
FIG. 3 shows the fire extinguisher of FIG. 1 in use extinguishing a kitchen cooking fire.

The fire extinguisher of the present invention is used to extinguish kitchen cooking fires. The user holds the handle 24 of the valve assembly in one hand and removes the ring pin 28 with the other hand. While continuing to hold the handle 24, the user grabs the hose 30 adjacent the finger guard 60. The user then squeezes the actuating lever 26 of the valve assembly opening the valve and beginning delivery of the agent mist to the fire through the hose 30 (FIG. 3). Since the user's hand is near the discharge outlet, the user must begin discharging agent to extinguish the fire before she or the fire extinguisher is close enough to the fire to come in contact with the grease.

It is also understood that since the hose is flexible, discharged agent cannot be properly directed without the user's hand being adjacent the nozzle assembly 40. Therefore, any suitable means requiring the user's hand placement adjacent the nozzle assembly 40 as required for directional spray control, such as a handle, a grip, and the like, are within the scope of my invention.

The previously described version of the present invention has many advantages, including a safe and effective fire fighting device for typical kitchen personnel. The user's hand placement guide provided by the finger guard in close proximity to the nozzle tip prevents the user from getting too close to the burning or hot cooking media, much less placing the nozzle tip in the cooking media. Moreover, the design of the discharge assembly naturally necessitates a hand placement adjacent the nozzle tip. The present invention thus disclosed above overcomes the drawbacks of the metal wand and nozzle tip use in conventional K class fire extinguishers. The design of the present invention also permits their installation into extinguisher cabinets and is more practical for busy kitchen traffic areas where discharge wands are often bumped from their holders during transportation or while hanging on the wall.

Although the present invention has been described in detail in connection with a particular embodiment thereof, other versions are possible. It is understood, of course, that I do not intend to limit the invention to that embodiment since modifications may be made by those skilled in the art, particularly in light of the foregoing teachings. For example, the finger guard may be replaced by a hand grip or similar component which prompts the user to hold the discharge assembly adjacent the nozzle tip. I intend to cover all such alternatives, modifications and equivalents as may be included within the spirit and scope of the invention as defined by the appended claims.

I claim:

1. A portable, wet chemical fire extinguisher for use in extinguishing combustible liquid fires, the fire extinguisher comprising:

a pressurized container for housing the fire suppressing wet chemical;

a discharge assembly mounted on the container in fluid communication with the fire suppressing wet chemical in the container, the discharge assembly including a length of conduit having an outlet for the wet chemical, the conduit comprising a material which is sufficiently flexible so as to require a user's hand position adjacent the outlet for directing the wet chemical discharged from the outlet, and a nozzle disposed in the outlet of the conduit, the nozzle having an axial orifice for discharging the wet chemical as a liquid mist; and a guard member having an axial opening for receiving the conduit, the guard member mounted on the conduit between the user's band position and the outlet in an axial position relative to the nozzle orifice such that the guard member is not in the path of the discharged mist, the guard member having a greater cross-sectional area than the conduit for allowing the user's hand position adjacent the outlet without interfering with the discharge of the mist of fire suppressing wet chemical from the nozzle.

2. A portable, wet chemical fire extinguisher as recited in claim 1, wherein the conduit comprises a flexible hose.

3. A portable, wet chemical fire extinguisher as recited in claim 1, wherein the guard member comprises a hollow casing having a first open end and a closed second end having an opening for receiving the outlet end of the conduit within the casing.

4. A portable, wet chemical fire extinguisher as recited in claim 3, wherein the first end of the casing extends beyond the nozzle.

5. A portable, wet chemical fire extinguisher as recited in claim 1, wherein the guard member comprises a handle adjacent the outlet.

6. A portable, wet chemical fire extinguisher as recited in claim 1, wherein the guard member comprises a grip adjacent the outlet.

7. A method for extinguishing combustible liquid fires, the method comprising the steps of:

providing a portable, wet chemical fire extinguisher comprising a pressurized container for housing the fire suppressing wet chemical, a discharge assembly mounted on the container in fluid communication with the fire suppressing wet chemical in the container, the discharge assembly including a conduit having an outlet for the wet chemical, the conduit comprising a material which is sufficiently flexible so as to require a user's hand position adjacent the outlet for directing the wet chemical discharged from the outlet, and a nozzle disposed in the outlet of the conduit, the nozzle having an axial orifice for discharging the wet chemical as a liquid mist, and a guard member having an axial opening for receiving the conduit, the guard member mounted on the conduit between the user's hand position and the outlet in an axial position relative to the nozzle orifice such that the guard member is not in the path of the discharged mist, the guard member having a greater cross-sectional area than the conduit for allowing the user's hand position adjacent the outlet without interfering with the discharge of the mist of fire suppressing wet chemical from the nozzle;

positioning a hand of the user adjacent the outlet for directing the discharged agent; and discharging agent.

8. A method of extinguishing a fire as recited in claim 7, wherein the conduit comprises a flexible hose.

9. A method of extinguishing a fire as recited in claim 7, wherein the guard member comprises a hollow casing having a first open end and a closed second end having an opening for receiving the outlet end of the conduit within the casing.

10. A method of extinguishing a fire as recited in claim 7, wherein the guard member comprises a handle adjacent the outlet.

11. A method of extinguishing a fire as recited in claim 7, wherein the guard member comprises a grip adjacent the outlet.

12. A portable, wet chemical fire extinguisher as recited in claim 1, wherein the guard member comprises a non-electrically conductive material.

13. Apparatus for use by an operator in the locality of an ambient fire, for extinguishing the fire's flames, comprising:

a container, for housing a fire suppressing agent under pressure; and a discharge assembly including a valve assembly mounted thereto in fluid communication with the fire suppressing agent, the valve assembly being adapted for hand actuation by the operator to release the fire suppressing agent, a conduit of selected length, the conduit including an intake end for receiving fire suppressing agent released from the container with actuation of the valve assembly, and including a discharge end comprising a nozzle having an axial orifice for releasing the suppressing agent under pressure as a mist, from the conduit, into the ambient, the conduit comprising a material which is sufficiently flexible so as to require the operator to grasp the discharge end in directing the released suppressing agent to the locality of the fire, the discharge end having mounted thereon a hand guard in an axial position relative to the nozzle orifice such that the hand guard is not in the path of the discharged mist, the discharge end adapted to be grasped by the operator in a manner such that the hand guard is between the operator's hand and the nozzle, the hand guard having a greater cross-sectional area than the conduit for allowing the operator's grasp adjacent the discharge end without interfering with the release of the mist of the suppressing agent from the nozzle.

14. The apparatus of claim 13, wherein the fire suppressing agent is of a wet chemical type.

15. The apparatus of claim 13, wherein the length of the conduit is selected to be that which permits an operator to actuate the valve assembly while simultaneously grasping the hand guard.

16. The apparatus of claim 13, wherein the length of the conduit is selected to prevent the discharge end thereof from extending beyond the immediate proximity of the operator.

17. The apparatus of claim 13, wherein the conduit comprises a flexible hose material.

18. The apparatus of claim 17, wherein the conduit comprises a rubber hose.

* * * * *

UNITED STATES PATENT AND TRADEMARK OFFICE

CERTIFICATE OF CORRECTION

PATENT NO. : 6,527,058 B1
DATED : March 4, 2003
INVENTOR(S) : John R. Nerat

It is certified that error appears in the above-identified patent and that said Letters Patent is hereby corrected as shown below:

Column 4,
Line 65, change “band” to -- hand --.

Signed and Sealed this

Sixth Day of May, 2003

JAMES E. ROGAN
*Director of the United States Patent and Trademark Office*